United States Patent [19]

Duhamel

[11] Patent Number: 4,483,173

[45] Date of Patent: Nov. 20, 1984

[54] DEVICE FOR THE AUTOMATIC REGULATION OF THE PUSH RODS OF A STAMPING PRESS

[75] Inventor: Gérard Duhamel, Mallemort, France

[73] Assignee: Societe Nationale Industrielle Aerospatiale, Paris, France

[21] Appl. No.: 360,842

[22] Filed: Mar. 22, 1982

[30] Foreign Application Priority Data

Apr. 1, 1981 [FR] France ..... 81 06526

[51] Int. Cl.[3] ..... B21D 22/00

[52] U.S. Cl. ..... 72/351; 72/20; 72/465

[58] Field of Search ..... 72/347, 456, 465, 351, 72/352, 20; 164/343

[56] References Cited

U.S. PATENT DOCUMENTS

| | | | |
|---|---|---|---|
| 2,283,356 | 5/1942 | Ernst . | |
| 2,300,162 | 10/1942 | Maude | 72/20 |
| 2,350,884 | 6/1944 | Ernst | 72/20 |
| 2,745,366 | 5/1956 | Japikse | 72/20 |
| 3,147,723 | 9/1964 | Williamson | 72/20 |
| 3,453,848 | 7/1969 | Williamson | 72/20 |
| 3,861,192 | 1/1975 | Suzuki | 72/456 |

FOREIGN PATENT DOCUMENTS 533172 2/1941 United Kingdom .

*Primary Examiner*—Leon Gilden

*Attorney, Agent, or Firm*—Kerkam, Stowell, Kondracki & Clarke

[57] ABSTRACT

Process and device for the automatic regulation of the push rods of a press by means of a self-locking rod jack. The device comprises a table, a matrix, a blank holder, a main slide, a punch and a blank holder slide. Each of the push rods comprises a jack rod mounted on the blank holder slide. The jack is equipped with an automatically lockable and unlockable device for regulating the length by sensing. At their lower end, in each case the rods have means for the high-speed locking to the blank holder.

5 Claims, 3 Drawing Figures

DEVICE FOR THE AUTOMATIC REGULATION OF THE PUSH RODS OF A STAMPING PRESS

BACKGROUND OF THE INVENTION

The present invention relates to a device for the automatic regulation or setting of the push rods of a stamping press. It also relates to a process for using this device.

Hydraulic stamping presses make it possible to stamp hollow parts from metal blanks. Such a press comprises a frame, a table to which is fixed the die and a main slide which moves in translation with respect to the table along the slideways. This slide carries a punch, whose shape is complementary to that of the impression of the die. Shaping, without metal removal, is brought about in equipment not forming part of the machine. The closing, operation and opening of the equipment at the requested shaping pressure takes place by means of a hydraulic cylinder.

A blank holder positioned between the table and the main slide keeps the sheet metal blank locked against the die during the stamping operation. The blank holder also moves in translation with respect to the table in order to supply the press with parts to be stamped and in order to remove the stamped parts.

The necessary clamping force exerted on the blank holder by a blank holder slide located above the main slide is transmitted by push rods. These push rods are in the form of elongated rods traversing the main slide and whose upper end is supported beneath the blank holder slide and whose lower end is supported on the actual blank holder. Transverse ring members are located in the push rods to prevent them from dropping during the outward movement of the main slide during the setting or regulating phases. The upward return of the blank holder is ensured by the main slide using tie bolts which pass through the latter. The lower end of each tie bolt is screwed to the blank holder and is supported by a shoulder of the upper end thereof on the main slide.

In the case of a press of this type, it is necessary to regulate the push rods prior to any stamping of a new series of parts. However, the setting operations take a long time, namely about 2 hours, so that these very expensive machines have to be stopped, which increases production costs. Moreover, these operations are irksome to the operator due to the number and weight of the push rods to be manipulated.

Therefore, considerable interest is attached to reducing the duration of the push rod setting operation. This is the problem solved by the present invention.

BRIEF SUMMARY OF THE INVENTION

The invention relates to a device for the automatic regulation of the push rods of a stamping press, obviating the need for their handling, fitting and setting. To this end, the prior art push rods are replaced by jacks equipped with an automatic rod locking and unlocking system.

More specifically, the stamping press according to the invention comprises in per se known manner a table to which is clamped a die, a blank holder positioned above the table, a main slide moving vertically with respect to the table and to which is clamped a punch, a blank holder slide, push rods fixed at one of their . ends to the blank holder and at the other end of the blank holder slide, whereby said push rods transmit the clamping force of the blank holder slide to the blank holder. Each of the push rods comprises the rod of a jack mounted on the blank holder slide, said jack being provided with an automatically lockable and unlockable device for regulating the length by sensing, whereby at their lower end, the rods have means for the rapid locking to the blank holder.

The invention also relates to a process for the automatic regulation of the push rods of a stamping press. As a result of this process, it is no longer necessary to disassemble, reassemble and regulate the push rods for each equipment or tool change. It is then merely necessary to lock in the raised position the push rods not used with a particular blank holder. As a result of a programmable automaton, the selection of the push rods to be used and the display of the stamping parameters can be easily automated.

According to this process, with the equipment already mounted on the table the blank holder slide is lowered to abut against the stamping press slide, the rods of the jacks are unlocked and lowered until they abut against the blank holder, the locking of the rods is automatically controlled on the basis of a signal detecting the increase in the hydraulic pressure of the jacks and the ends of the rods are locked on the blank holder.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
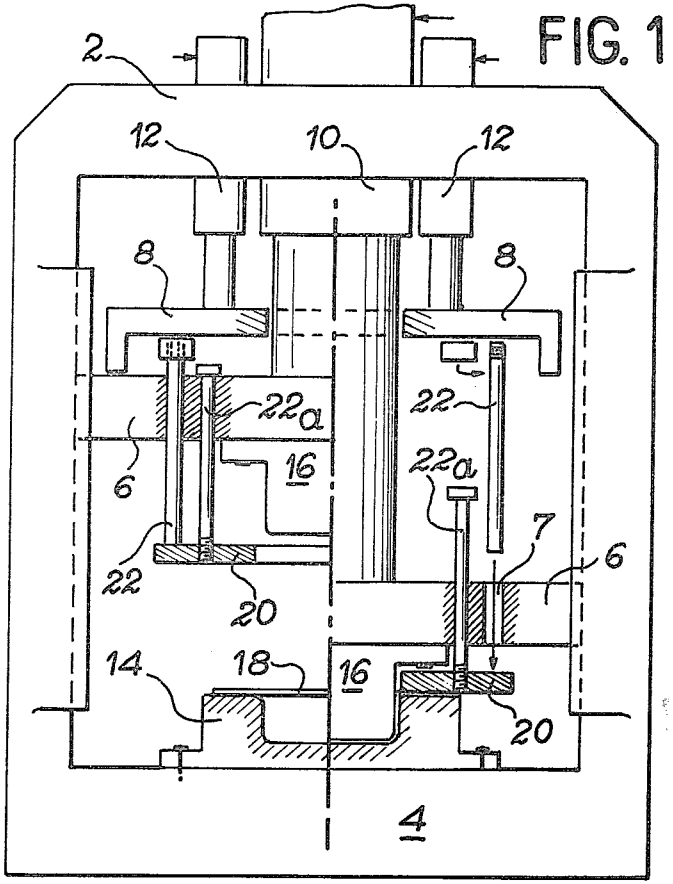
FIG. 1 a prior art hydraulic stamping press.

FIG. 1 shows a prior art stamping press comprising a frame 2, a table 4, a main slide 6 and a blank holder slide 8. The main slide is controlled by the main cylinder 10. The blank holder slide 8 is controlled by at least two cylinders 12 with a plunger ram. The die 14 is clamped to table 4.

In the left-hand half-view of FIG. 1, main slide 6 and blank holder slide 8 are shown in the raised position. In the right-hand half-view, main slide 6 and blank holder slide 8 are lowered, so that they are in contact with the equipment or tools.

A press of this type is called a double action press, because it has two different slides actuated by two separate jack systems. A triple action stamping press has the same components, which fulfil the same functions. An up stroke beneath table 4 is merely added thereto. Punch 16 is fixed to main slide 6, which is also called the stamping press slide. The sheet metal blank 18 to be stamped is positioned on die 14. The function of blank holder 20 is to fix the sheet metal blank 18 during the stamping operation. It is controlled by means of push rods 22 placed between the latter and the blank holder slide 8. The two jacks 12 abut slide 8 with main slide 6. The force transmitted by the push rods 22 to the blank holder 20 is consequently dependent on the length setting of the push rods. This setting or regulation is brought about by means of shims and requires a high degree of precision.

Moreover, these push rods, which are subsequently referred to as tie rods 22*a*, are slidingly mounted in bores made in the main slide 6 and at their lower end are screwed into the blank holder 20, whilst their upper end carries a shoulder preventing them from traversing the main slide 6. These tie rods ensure the lifting of the blank holder, as a result of the raising of slide 6.

When the press tools are changed, i.e. the die 14 and punch 16 for stamping a different series of parts, it is necessary to reset the length of the push rods 22. The push rods are changed in the following way. Firstly, the main slide 6 is lowered onto table 4 (cf FIG. 1, right-hand half-view) and the push rods 22 are introduced into opening 7 provided for this purpose in the slide. The retaining rings for push rods 20 are introduced in their upper part. The main slide 6 is raised and the press tools are introduced on table 4. These tools or equipment comprises in the manner stated hereinbefore a die 14, a punch 16 and a blank holder 20. The main slide 6 is lowered until it comes into contact with the tools. This main slide 6 is then in the position which it will occupy during the normal operation of the press at the end of the stamping operation, to within the thickness of the blank. The punch 16 is clamped to the lower face of the main slide 6 and the die to table 4. It then remains necessary to perform an adjustment between the upper end of push rods 22 and the lower face of blank holder slide 8 to make up for the allowances for wear. The main slide 6 is then raised, as is the blank holder slide 8, via tie rods 22*a*. The press is then ready to function.

All the fitting and regulating operations with respect to the push rods described hereinbefore take a long time, namely about 2 hours.

Figure 2:
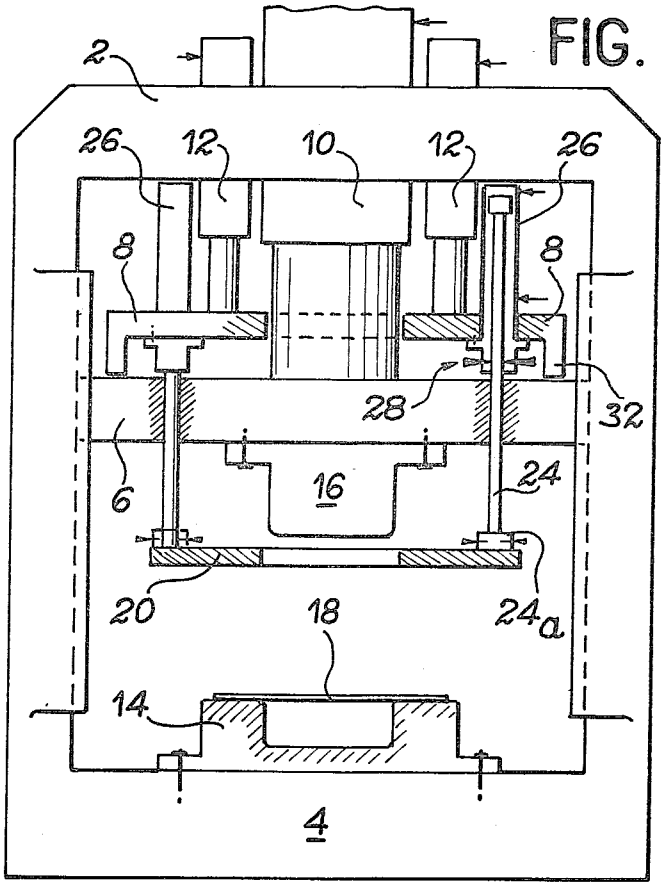
FIG. 2 a stamping press according to the invention.

FIG. 2 shows a stamping press according to the invention, which makes it possible to considerably reduce the time taken for the push rod setting operation. The general construction of the press is similar to that of FIG. 1 and it mainly comprises a frame 2, a table 4 a main slide 6 and a blank holder slide 8. The tools, i.e. die 14, punch 16 and blank holder 20 are identical.

According to the invention, the push rods which transmit the clamping force of the blank holder slide 8 to the blank holder 20, designated by reference numeral 22 is FIG. 1, are in this case constituted by the rods 24 of hydraulic jacks 26 vertically mounted on the blank holder slide 8. An automatic locking and unlocking device 28 is provided around each of these jack rods 24. At its lower end 24*a*, rod 24 has a system for the high-speed locking to the blank holder and which can be automatic.

Figure 3:
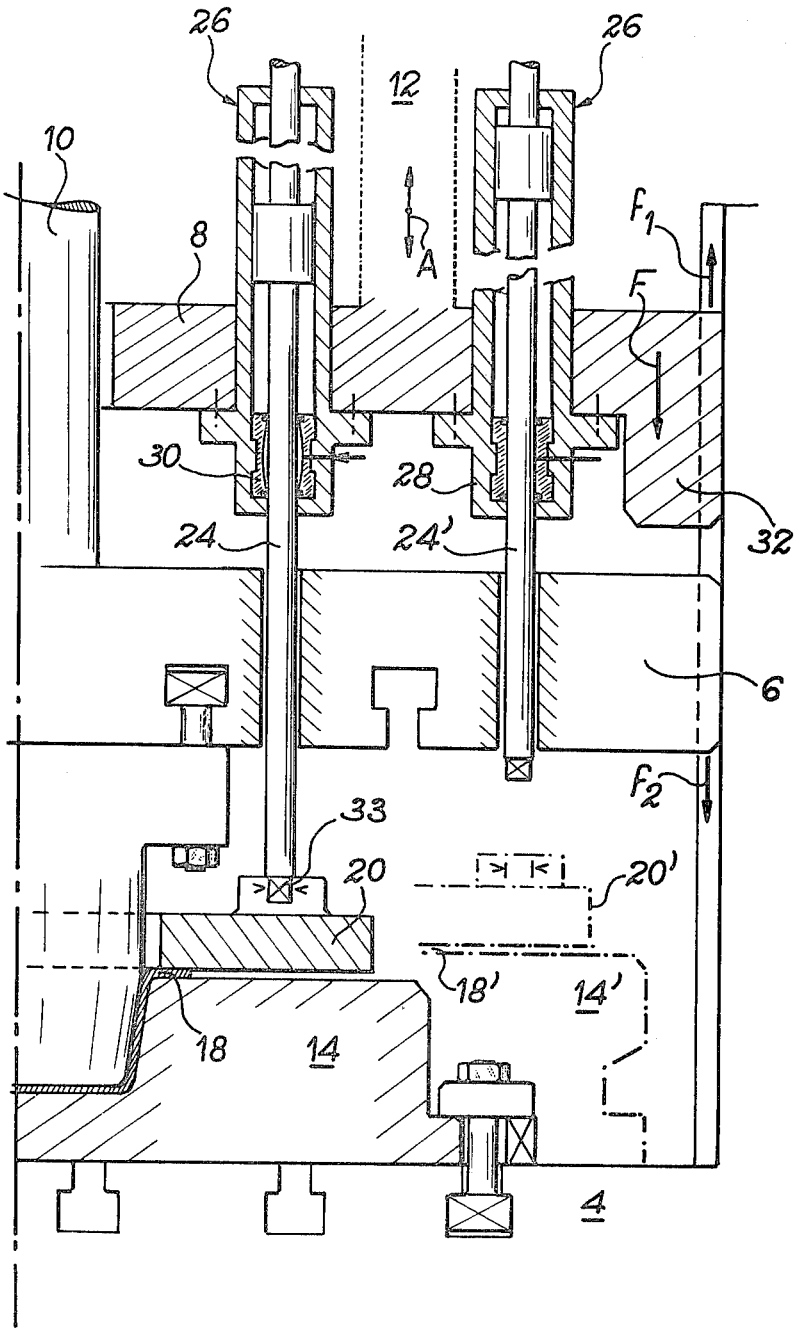
FIG. 3 a detail of the press of FIG. 2.

The means for locking and unlocking rod 24 of hydraulic jack 26 are shown on a larger scale in FIG. 3. Also, they preferably comprise a bush 30 surrounding rod 24. By means of bush 30, it is possible to lock and unlock rod 24 in such a way that frictional forces lock it in position. Rod 24 is locked on exerting a hydraulic pressure outside bush 30. Unlocking takes place when no pressure is exerted. Preferably, a reverse locking system is used, in which the bush 30 has an inner bore, whose diameter is less than that of rod 24. This leads to a definite frictional connection due to the elastic deformation of the materials present. Unlocking is obtained by a hydraulic pressure uniformly applied to the interior of bush 30 between the two contacting surfaces. The "auto-lock" system manufactured and marketed by the Quiri Company is an automatic locking system which can be very satisfactory and used in a press according to the invention.

The change of tools or equipment and the regulation of the push rod by means of the device according to the invention take place in the following way. Starting with the press in the rest position, i.e. with the main slide 6 and blank holder slide 8 in the raised position, the tools are fitted and centred on table 4. In order to reduce the time taken by this operation, a high-speed hydraulic clamping device is used.

The main slide 6 is lowered and punch 16 is clamped to the lower face thereof. As for the die 14, clamping can be carried out by means of a high-speed hydraulic clamping device. The travel of the blank holder slide 8 is defined by stopping the main slide at the top dead centre in a position chosen as a function of the tools. This position is more particularly dependent on the thickness of the blank to be stamped.

The blank holder slide 8 is lowered so that it abuts with the main slide. Thus, as can be seen in FIGS. 2 and 3, the blank holder slide 8 has in its lower part abutments 32 for providing a clearance between the lower part of the locking and unlocking device 28 and the upper face of the main slide 6. With slide 8 in abutment, the jack rods 24 are unlocked and lowered until they abut against the blank holder 20. The latter has a high-speed locking and unlocking device 33 for end 24*a*. According to a variant, this locking 33 can be carried out automatically. Once end 24*a* abuts against the blank holder 20, the hydraulic pressure within jack 26 rapidly increases, because the volume available for the fluid does not increase. The detection of this pressure rise makes it possible to process a signal, which on the one hand interrupts the low pressure hydraulic supply for jack 26 and on the other hand blocks rod 24 by means of device 28.

According to a preferred embodiment of the invention, the locking of rod 24 is obtained by means of cancelling out the hydraulic pressure exerted within bush 30. This pressure elimination simultaneously in the bush and in the jack is controlled by a pressostat when the jack supply pressure reaches a predetermined threshold, which is below the overall regulating pressure of the press. Thus, in the case of a breakdown in the hydraulic supply to the device, the hold of rod 24 is ensured by friction in bush 30, any risk of undesired manipulation being avoided. The main slide 6 and blank holder slide 8 are then raised into the upper position, the press then being ready to operate.

The regulation of the push rods of the press in the manner described hereinbefore makes it possible to reduce the tool setting times to about 5 minutes. This permits a more frequent change of tools and therefore leads to the elimination of press shutdown times during waits at stamping interfaces for heat treatment operations. Moreover, the definition of the travel of the push rods by sensing, makes it possible to automatically make up for allowances for wear at the time of each setting operation.

In addition, there are no longer any manipulations or storage of the push rods. Thus, at the time of changing the press tools, it is not necessary to dismantle the push rods which are not to be used. FIG. 3 shows two different sets of tools, namely on the one hand die 14 and blank holder 20 and the other die 14' and blank holder 20'. When using die 14 and blank holder 20, a certain number of push rods, e.g. push rod 24' is not used. It is then merely necessary to raise it into the upper position, as shown in FIG. 3 and to lock it in this position by means of the automatic locking and unlocking device 28. In the represented embodiment, this locking operation is performed through lack of pressure. As a result of a programmable automaton, the selection of the push buttons to be used and the display of the stamping parameters are automatic.

What is claimed is:

1. A blanking press comprising a table to which is clamped a die, a blank holder located on the table, a main slide moving vertically with respect to the table and to which is clamped a punch, a blank holder slide, at least one blank holder jack for moving the blank holder slide vertically with respect to the table, and push rods fixed by one of their ends to the blank holder and by their other ends to the blank holder slide, said push rods serving to transmit the clamping force of the blank holder slide to the blank holder, hydraulic jacks mounted on the blank holder slide and including jack rods which constitute the push rods, each of said jacks being provided with an automatic locking and unlocking device operable to automatically lock the jack rod in a fixed position when the end of the jack rod abuts the blank holder, and means at said one of the rods for high-speed locking to the blank holder.

2. A device according to claim 1, wherein the means for locking and unlocking the jack rod comprise a bush mounted around said rod and fixed to the jack cylinder, locking and unlocking of the rod taking place by clamping controlled by hydraulic pressure.

3. A device according to claim 2, wherein the locking of the rod takes place by means of a hydraulic pressure exerted on the outside of the bush.

4. A device according to claim 2, wherein the bush has an internal bore smaller than the diameter of the rod such that locking occurs by frictional contact between the bush and the rod accompanied by elastic deformation of the bush, unlocking being obtained by hydraulic pressure uniformly applied between the bush and the rod.

5. A process for regulating the blank holder push rods of a press including a table to which is clamped a die, a blank holder located on the table, a main slide moving vertically with respect to the table and to which is clamped a punch, a blank holder slide, and push rods fixed by one of their ends to the blank holder and by their other ends to the blank holder slide, said push rods serving to transmit the clamping force of the blank holder slide to the blank holder, hydraulic jacks mounted on the blank holder slide and including jack rods which constitute the push rods, each of said jacks being provided with an automatic locking and unlocking device operable to automatically lock the jack rod in a fixed position when the end of the jack rod abuts the blank holder, said process comprising the steps of:

mounting the die and blank holder on the table, lowering the blank holder slide to abut against the stamping press slide, automatically unlocking the rods of the jacks and lowering the rods until they abut against the blank holder, automatically controlling the locking of the rods on the basis of a signal detecting an increase in the hydraulic pressure of the jacks, and locking the ends of the rods on the blank holder.

* * * * *